US007788751B1

(12) United States Patent
Diemer et al.

(10) Patent No.: US 7,788,751 B1
(45) Date of Patent: Sep. 7, 2010

(54) SITTING NECK SUPPORT DEVICE

(75) Inventors: Stephen K. Diemer, N2930 Cooke La., Marinette, WI (US) 54143; Rodney T. Herdina, Forest Lake, MN (US); Janet L. Diemer, Marinette, WI (US)

(73) Assignee: Stephen K. Diemer, Marinette, WI (US)

( * ) Notice: Subject to any disclaimer, the term of this patent is extended or adjusted under 35 U.S.C. 154(b) by 0 days.

(21) Appl. No.: 12/365,184

(22) Filed: Feb. 4, 2009

(51) Int. Cl.
*A47C 7/36* (2006.01)
*A47C 16/00* (2006.01)
*A47C 20/00* (2006.01)
*A47G 9/10* (2006.01)

(52) U.S. Cl. ..... 5/644; 5/638; 5/640; 297/391

(58) Field of Classification Search ..... 5/644, 5/636–640, 645, 654, 655.3, 657; 297/391–393
See application file for complete search history.

(56) References Cited

U.S. PATENT DOCUMENTS

| | | | | | |
|---|---|---|---|---|---|
| 3,112,956 | A * | 12/1963 | Schick et al. | 297/219.1 |
| 3,164,151 | A * | 1/1965 | Vere Nicoll | 602/18 |
| 3,253,861 | A * | 5/1966 | Howard | 297/452.43 |
| 3,602,928 | A * | 9/1971 | Helzer | 5/644 |
| 3,795,021 | A * | 3/1974 | Moniot | 5/644 |
| 4,235,472 | A * | 11/1980 | Sparks et al. | 297/392 |
| 4,236,264 | A * | 12/1980 | Britzman | 5/640 |
| 4,550,458 | A * | 11/1985 | Fiore | 5/637 |
| 4,576,150 | A * | 3/1986 | Auracher | 602/18 |
| 4,889,109 | A * | 12/1989 | Gifford | 606/237 |
| 5,060,324 | A * | 10/1991 | Marinberg et al. | 5/81.1 T |
| 5,103,514 | A * | 4/1992 | Leach | 5/417 |
| 5,378,042 | A * | 1/1995 | Daneshvar | 297/393 |
| 5,474,361 | A * | 12/1995 | Hwang et al. | 297/380 |
| 5,505,523 | A * | 4/1996 | Wang | 297/393 |
| 5,611,601 | A * | 3/1997 | Cowgur | 297/393 |
| 5,645,319 | A * | 7/1997 | Parks, Jr. | 297/391 |
| 6,042,185 | A * | 3/2000 | Cowgur | 297/393 |
| 6,647,573 | B2 * | 11/2003 | Corbin | 5/655.3 |
| 6,745,418 | B1 * | 6/2004 | Turner, Jr. | 5/638 |
| 6,973,691 | B1 * | 12/2005 | Cordova et al. | 5/652 |
| 7,444,698 | B2 * | 11/2008 | Jackson, III | 5/644 |
| 2006/0150336 | A1 * | 7/2006 | Jackson, III | 5/644 |

* cited by examiner

*Primary Examiner*—Robert G Santos
(74) *Attorney, Agent, or Firm*—Donald J. Ersler

(57) ABSTRACT

A sitting neck support device preferably includes a support base and at least one air valve. The support base includes a first boundary sheet and a second boundary sheet. The perimeters of the first and second boundary sheets are secured to each other. A breathing opening and two hand openings are preferably formed in the support base. A plurality of air chambers are formed in the support base with a plurality of partitions. First and second positioning straps extend from opposing ends of the support base. A strip of hook or loop fastener is preferably applied to the first and second positioning straps. In use, the sitting neck support device is inflated with the at least one air valve. The support base is curled into a substantial cylinder by securing the first and second positioning straps; tucked under the face; and placed on or over the legs of a user.

14 Claims, 5 Drawing Sheets

SITTING NECK SUPPORT DEVICE

BACKGROUND OF THE INVENTION

1. Field of the Invention

The present invention relates generally to neck support, while sitting and more specifically to a sitting neck support device, which provides physical comfort to a user sitting in the same location for a long period of time.

2. Discussion of the Prior Art

U.S. Pat. No. 4,161,946 to Zuesse discloses a support for maintaining head in upright position. The Zuesse patent includes a support for maintaining the head in an upright position, for example, while resting or sleeping upright in a seat with a back rest. U.S. Pat. No. 5,330,255 to Stawicki discloses a seat integrated inflatable neck support. The Stawicki patent includes an inflatable neck support in the form of a U-shaped collar comprising an inflatable bladder and a decorative cover that provides a wide range of styling choices. U.S. Pat. No. 6,007,156 to Chang discloses a vertical rest helping method and apparatus. The Chang patent includes a method or an apparatus for helping a user rest and sleep, while in a vertical sitting position on a seat by providing vertical and horizontal support to the user's upper body and head.

Accordingly, there is a clearly felt need in the art for a sitting neck support device, which allows a user to rest or sleep, while sitting in the same location for a long period of time.

SUMMARY OF THE INVENTION

The present invention provides a sitting neck support device, which provides physical comfort to a user sitting in the same location for a long period of time. The sitting neck support device preferably includes a support base and at least one air valve. The support base includes a first boundary sheet and a second boundary sheet. A perimeter of the first boundary sheet is sealed to a perimeter of the second boundary sheet. A breathing opening and two hand openings are preferably formed in the first and second boundary sheets. The perimeters of the breathing and two hand openings must sealed to prevent the release of air.

A plurality of air chambers are formed in the support base by sealing the first and second boundary sheets together to form a plurality of partitions. A first positioning strap extends from one end of the support base and a second positioning strap extends from the other end of the support base. A strip of a hook or loop fastener is preferably applied to one of the positioning straps and the strip of loop or hook fastener is applied to the other positioning strap. However, other attachment methods besides hook and loop fasteners may also be used. The first and second positioning straps are secured to each other to form a substantially cylindrical shape. The air valve is preferably of the type that is pushed in to seal itself.

In use, the sitting neck support device is inflated by blowing into the at least one air valve. The support base is curled into the substantially cylindrical shape and tucked under the face and placed on or over the legs of the user. The first and second positioning straps are secured to each other when a comfortable position is found. The sitting neck support device may also be placed behind a user's back for extra seating comfort.

Accordingly, it is an object of the present invention to provide a sitting neck support device, which allows a user to rest or sleep, while sitting in the same location for a long period of time.

These and additional objects, advantages, features and benefits of the present invention will become apparent from the following specification.

DETAILED DESCRIPTION OF THE PREFERRED EMBODIMENTS

Figure 1:
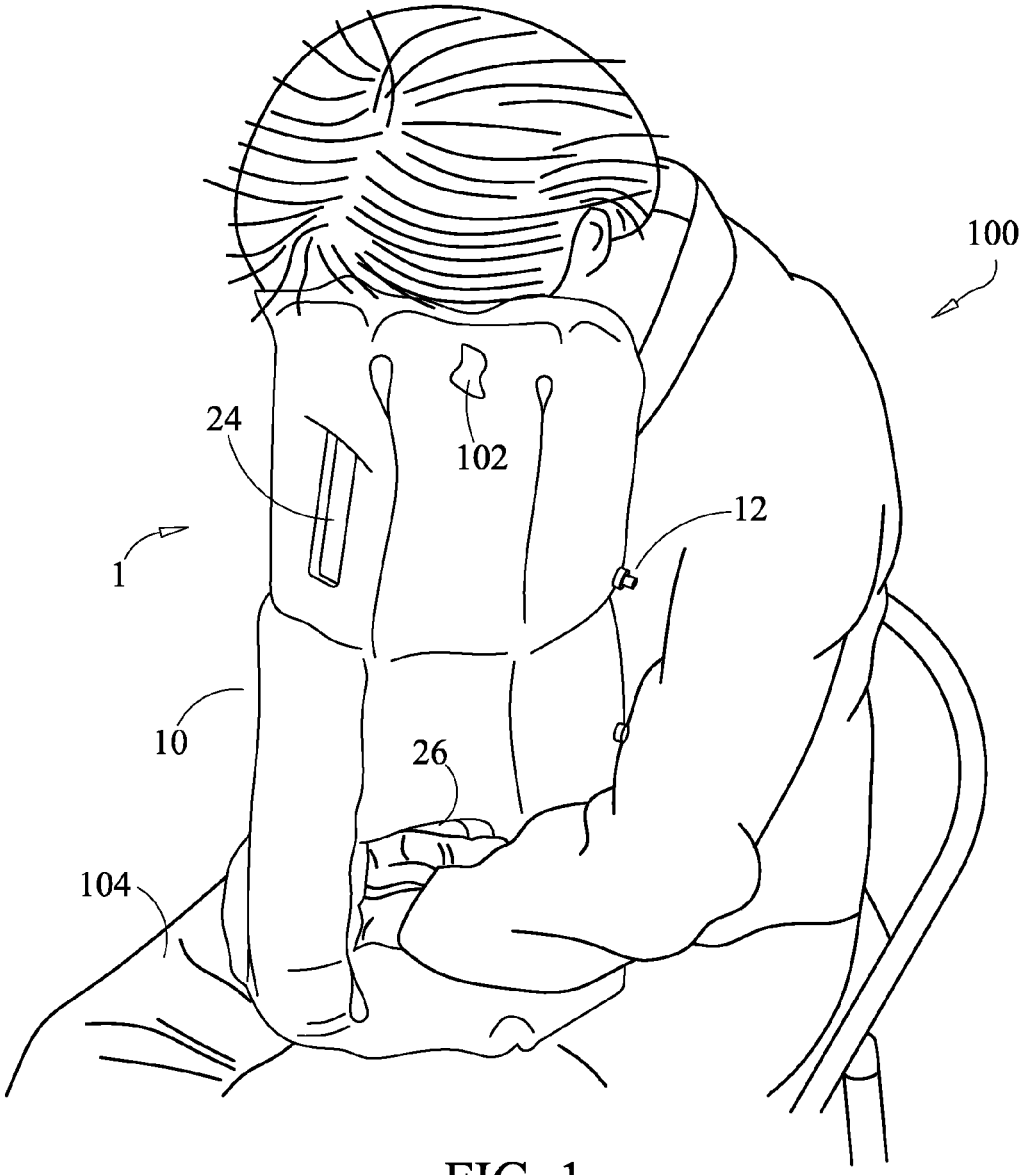
FIG. 1 is a perspective view of a sitting neck support device, while in use in accordance with the present invention.
Figure 2:
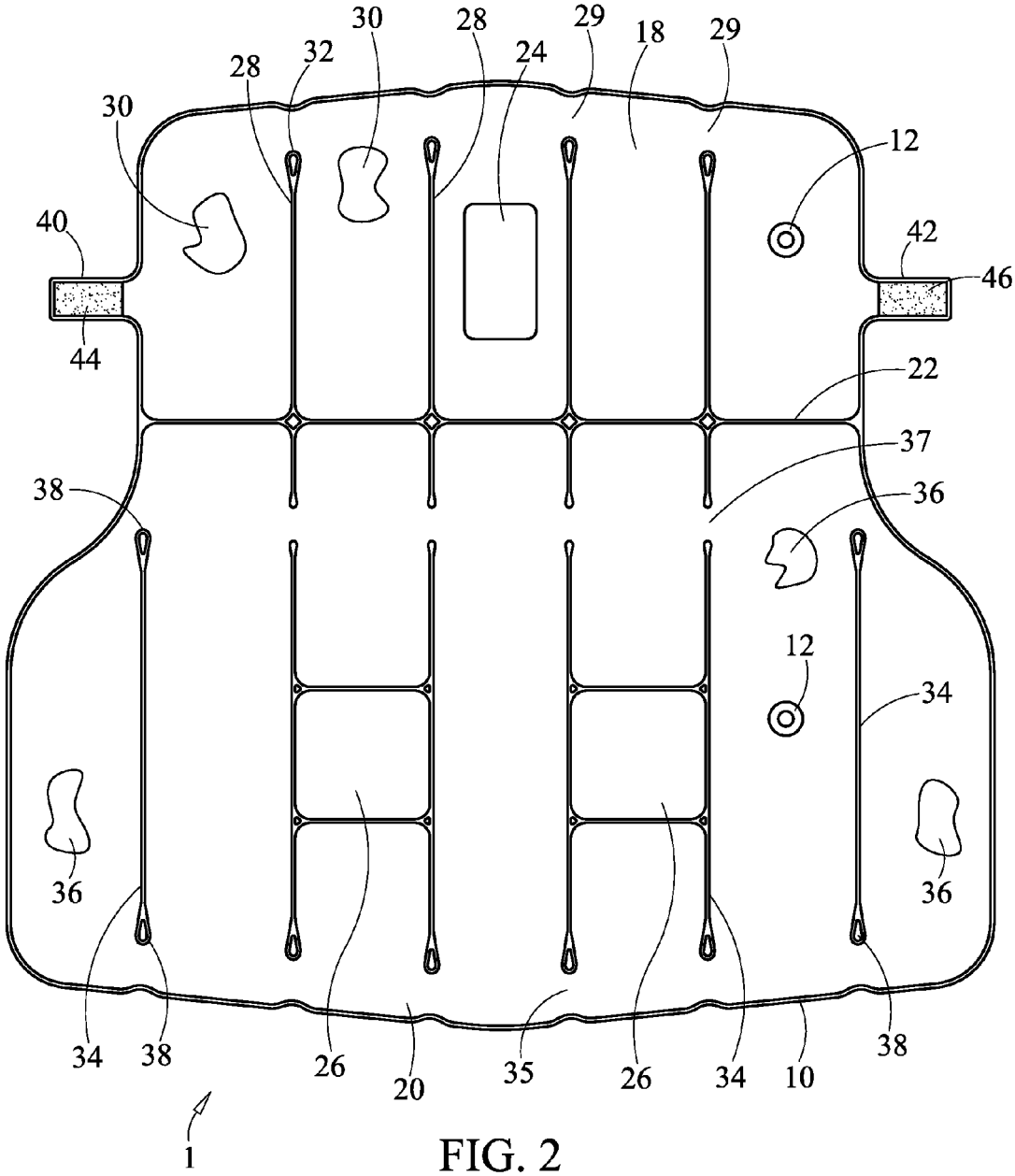
FIG. 2 is a top view of a flat and uninflated sitting neck support device in accordance with the present invention.
Figure 3:
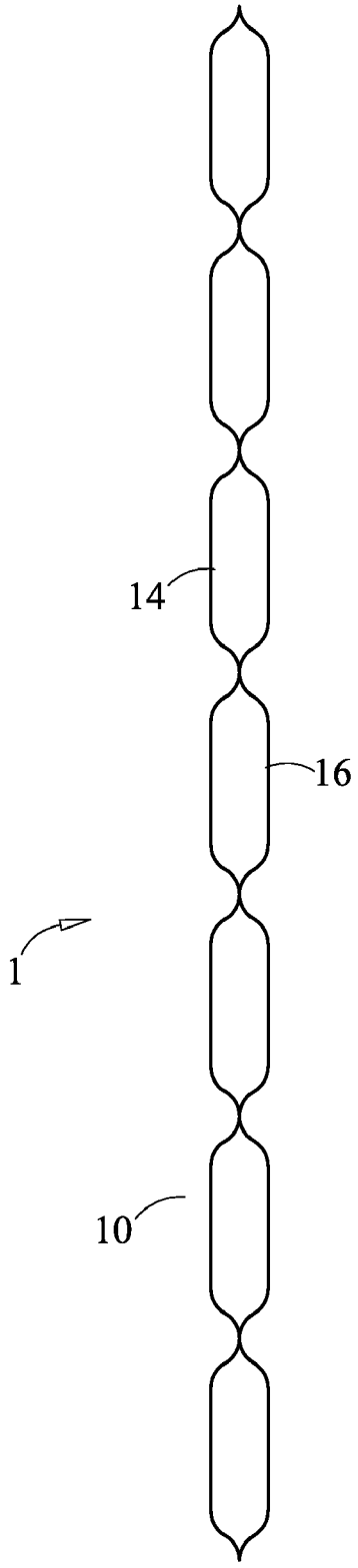
FIG. 3 is a cross sectional view of a slightly inflated sitting neck support device in accordance with the present invention.
Figure 4:
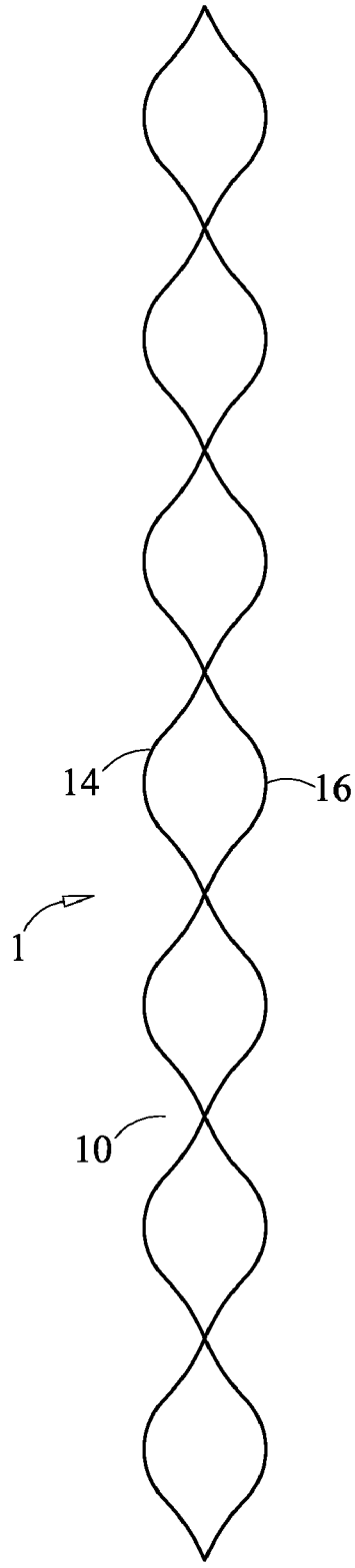
FIG. 4 is a cross sectional view of an inflated sitting neck support device in accordance with the present invention.
Figure 5:
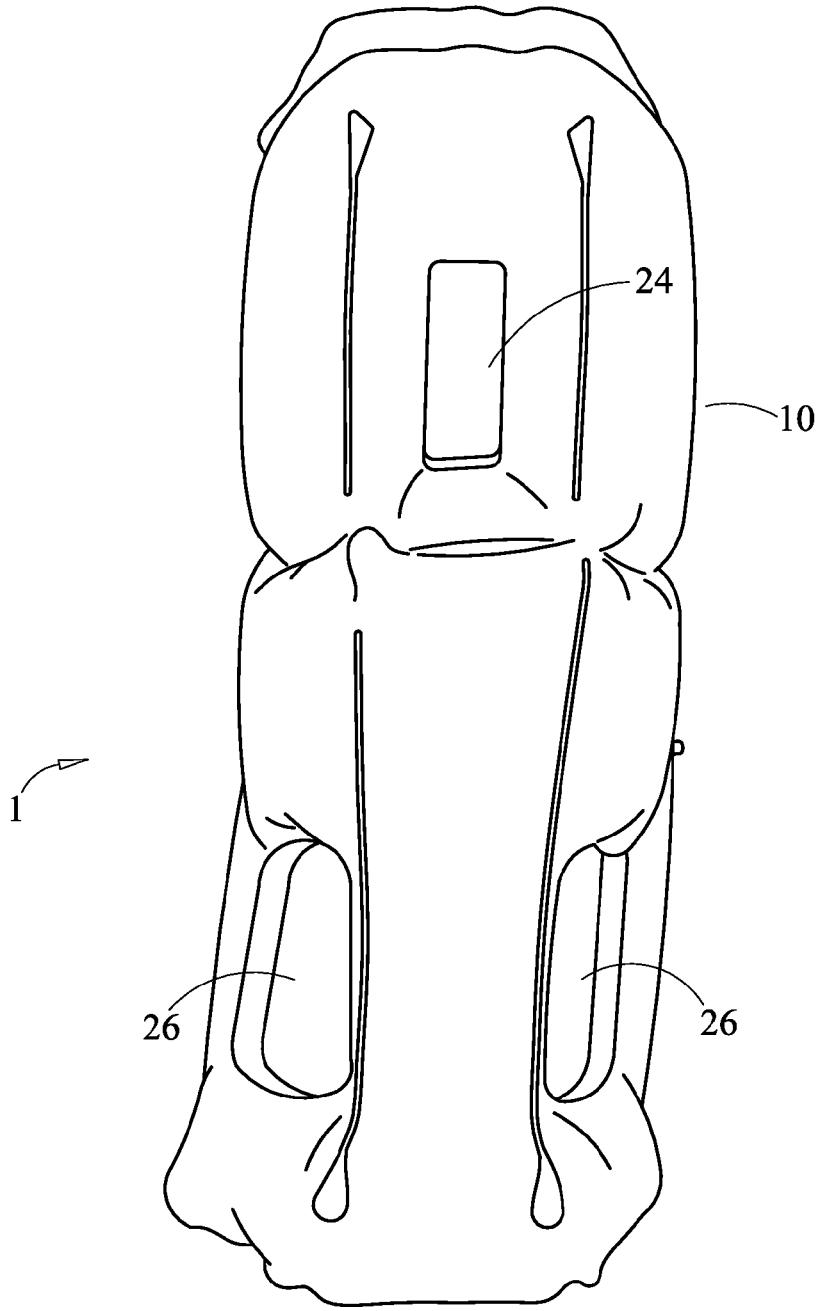
FIG. 5 is a front view of an inflated sitting neck support device in accordance with the present invention.
Figure 6:
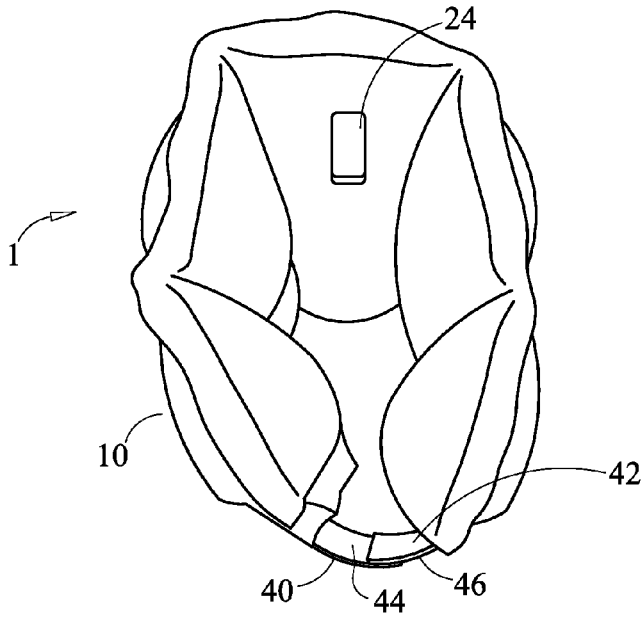
FIG. 6 is a top perspective view of an inflated sitting neck support device in accordance with the present invention.
Figure 7:
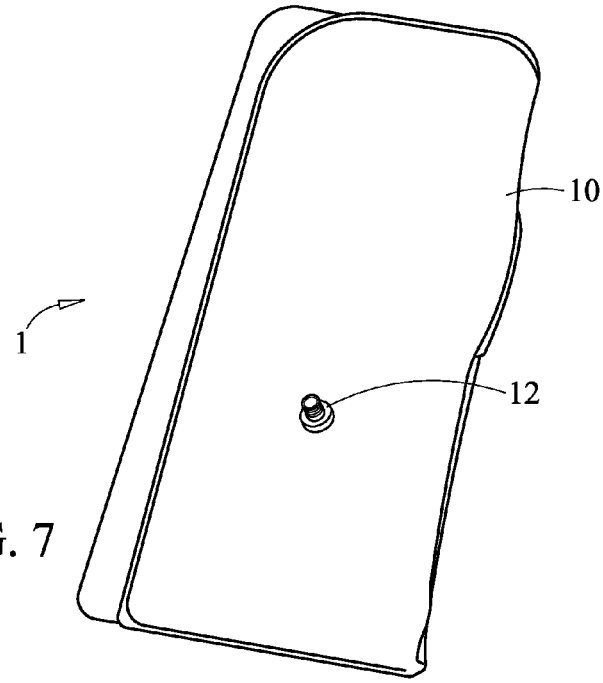
FIG. 7 is a top perspective view of a folded and uninflated sitting neck support device in accordance with the present invention.

With reference now to the drawings, and particularly to FIG. 1, there is shown a perspective view of a sitting neck support device 1, while in use. With reference to FIGS. 2-7, the sitting neck support device 1, preferably includes a support base 10 and at least one air valve 12. The support base 10 includes a first boundary sheet 14 and a second boundary sheet 16. The first and second boundary sheets are preferably fabricated from an air impervious plastic material, but other suitable materials may also be used. A perimeter of the first boundary sheet 14 is sealed to a perimeter of the second boundary sheet 16 with any suitable process. The support base 10 is preferably divided into a first inflatable area 18 and a second inflatable area 20 by a lengthwise sealing partition 22. A breathing opening 24 is preferably formed in a middle of the first inflatable area 18. Two hand openings 26 are preferably formed through the second inflatable area 20. The perimeters of the breathing and two hand openings must be sealed to prevent the release of air.

A plurality of first partitions 28 are formed in the first inflatable area 18 to form a plurality of first air chambers 30. Each first partition is preferably terminated with a relief end 32 to prevent tearing of the support base 10. A plurality of first gaps 29 are formed between an end of each first partition 28 and a perimeter of the support base 10. A plurality of second partitions 34 are formed in the second inflatable area 20 to form a plurality of second air chambers 36. Each second partition 34 is preferably terminated with a relief end 38 to prevent tearing of the support base 10. A plurality of second gaps 35 are formed between an end of each second partition 34 and a perimeter of the support base 10. A plurality of second interruption gaps 37 are formed through some of the plurality of second partitions 34, near the lengthwise sealing partition 22.

A first positioning strap 40 extends from one end of the support base 10 and a second positioning strap 42 extends from the other end of the support base 10. A first strip of a hook or loop fastener 44 is preferably applied to the first positioning strap 40 and a second strip of loop or hook fastener 46 is applied to the second positioning strap 42. However, other attachment methods besides hook and loop fasteners may also be used. For purposes of illustration convenience in FIG. 2, the first and second hook or loop fastener strip is shown on the same side of the first and second positioning straps, but in reality one should be on the front side and one on the back side of the first and second positioning straps. The first and second positioning straps are secured to each other to form the base support 10 with a substantially cylindrical shape. The at least one air valve 12 is preferably of the type that is pushed in to seal itself. The "push-in closure" type of air valve is well known in the art and need not be explained in further detail.

In use, the sitting neck support device 1 is inflated by blowing into the air valve 12 in the first inflatable area 18 and blowing into the air valve 12 in the second inflatable area 20. The volume of air from adult human lungs is sufficient to blow-up the first and second inflatable areas with only a few exhalations. The support base 10 is curled into a substantially cylindrical shape and tucked under the face 102 and placed on or over the legs 104 of a user 100, depending on the user's height and resting position. The first and second positioning straps are secured to each other when a comfortable position is found for the sitting neck support device 1. The sitting neck support device 1 may also be placed behind a user's back for extra seating comfort.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A sitting neck support device comprising:

a support base including a first boundary sheet and a second boundary sheet, a perimeter of said first boundary sheet is sealed to a perimeter of said second boundary sheet, one end of said support base is attached to the other end of said support base to form a substantially tubular shape, said substantially tubular shape has a length and a width, said width is less than said length, said length is oriented substantially vertical, wherein a face of a user is placed in contact with one end of said substantially tubular shape during use, a breathing opening is formed through said first and second boundary sheets at substantially said one end of said substantially tubular shape;

a plurality of air chambers are formed in said support base by sealing said first and second boundary sheets together to form a plurality of partitions; and at least one air valve being formed in at least one of said first boundary sheet and said second boundary sheet.

2. The sitting neck support device of claim 1, further comprising:

means for retaining said support base with both hands.

3. The sitting neck support device of claim 1, further comprising:

a first positioning strap being extended from a first side of said support base, a second positioning strap being extended from a second side of said support base.

4. The sitting neck support device of claim 3, further comprising:

one of a hook or loop fastener strip being attached to said first positioning strap and one of a loop or hook fastener being attached to said second positioning strap.

5. The sitting neck support device of claim 1, further comprising:

said at least one air valve being of a type that is pushed in to seal itself.

6. A sitting neck support device comprising:

a support base including a first boundary sheet and a second boundary sheet, a perimeter of said first boundary sheet is sealed to a perimeter of said second boundary sheet, one end of said support base is attached to the other end of said support base to form a substantially tubular shape, one of said first and second boundary sheets forming an inner perimeter surface of said substantially tubular shape, said substantially tubular shape further includes a length and a width, said width is less than said length, said length is oriented substantially vertical, wherein a face of a user is placed in contact with one end of said substantially tubular shape during use, a breathing opening is formed through said first and second boundary sheets at substantially said one end of said substantially tubular shape;

a plurality of air chambers are formed in said support base by sealing said first and second boundary sheets together to form a plurality of partitions; and at least one air valve being formed in at least one of said first boundary sheet and said second boundary sheet.

7. The sitting neck support device of claim 6, further comprising:

means for retaining said support base with both hands.

8. The sitting neck support device of claim 6, further comprising:

a first positioning strap being extended from a first side of said support base, a second positioning strap being extended from a second side of said support base.

9. The sitting neck support device of claim 8, further comprising:

one of a hook or loop fastener strip being attached to said first positioning strap and one of a loop or hook fastener being attached to said second positioning strap.

10. The sitting neck support device of claim 6, further comprising:

said at least one air valve being of a type that is pushed in to seal itself.

11. A sitting neck support device comprising:

a support base including a first boundary sheet and a second boundary sheet, a perimeter of said first boundary sheet is sealed to a perimeter of said second boundary sheet, one end of said support base is attached to the other end of said support base to form a substantially tubular shape, said substantially tubular shape further includes a length and a width, said width is less than said length, said length is oriented substantially vertical, wherein a face of a user is placed in contact with one end of said substantially tubular shape during use, a breathing opening is formed through said first and second boundary sheets at substantially said one end of said substantially tubular shape;

a plurality of air chambers are formed in said support base by sealing said first and second boundary sheets together to form a plurality of partitions; and at least one air valve being formed in at least one of said first boundary sheet and said second boundary sheet, said plurality of air chambers are filled with air before use through said at least one air valve.

12. The sitting neck support device of claim 11, further comprising:

means for retaining said support base with both hands.

13. The sitting neck support device of claim 11, further comprising:

one of a hook or loop fastener strip being attached to said first positioning strap and one of a loop or hook fastener being attached to said second positioning strap.

14. The sitting neck support device of claim 11, further comprising:

said at least one air valve being of a type that is pushed in to seal itself.

* * * * *